US005678459A

United States Patent [19]

Motohashi et al.

[11] Patent Number: 5,678,459

[45] Date of Patent: Oct. 21, 1997

[54] ROCKER ARM

[75] Inventors: Nobutsuna Motohashi, Gose; Kenji Takahashi, Kashihara, both of Japan

[73] Assignee: Koyo Seiko Co., Ltd., Osaka, Japan

[21] Appl. No.: 350,118

[22] Filed: Nov. 29, 1994

[30] Foreign Application Priority Data

Nov. 29, 1993 [JP] Japan ..... 5-298028

[51] Int. Cl.[6] ..... F01L 1/18

[52] U.S. Cl. ..... 74/559; 123/90.39; 123/90.41

[58] Field of Search ..... 74/559; 123/90.39, 123/90.41, 90.42, 90.44

[56] References Cited

U.S. PATENT DOCUMENTS

| | | | |
|---|---|---|---|
| 2,199,914 | 3/1940 | Haberstump . | |
| 3,096,749 | 7/1963 | Davidson | 74/559 |
| 3,418,985 | 12/1968 | Hirose | 123/90.39 |
| 4,872,429 | 10/1989 | Anderson et al. | 123/90.44 |
| 5,010,857 | 4/1991 | Hempelmann et al. | 123/90.39 |
| 5,016,582 | 5/1991 | Mills | 123/90.39 |

FOREIGN PATENT DOCUMENTS

| | | | |
|---|---|---|---|
| 0 573 674 A1 | 12/1993 | European Pat. Off. . | |
| 57-20509 | 2/1982 | Japan . | |
| 58-152503 | 10/1983 | Japan . | |
| 63-272903 | 11/1988 | Japan . | |
| 5179907 | 7/1993 | Japan | 123/90.39 |

*Primary Examiner*—Rodney H. Bonck
*Assistant Examiner*—Mary Ann Battista
*Attorney, Agent, or Firm*—Reid & Priest LLP

[57] ABSTRACT

A rocker arm comprises: a rocker arm body having a pair of side walls, a pivot shaft mounting portion at one end, and a valve engaging portion at the other end; and a roller rotatably mounted on the rocker arm body at the middle. In the rocker arm, at least the side walls are prepared by blanking a plate material, and the pivot shaft mounting portion and the valve engaging portion are connected, as bridges, between the side walls, and a thread hole is formed in the pivot shaft mounting portion in such a manner that its length is larger than the wall thickness of the side walls.

7 Claims, 5 Drawing Sheets

ROCKER ARM

BACKGROUND OF THE INVENTION

1. Field of the Invention

This invention relates to a rocker arm provided in the valve opening and closing mechanism of an engine.

2. Discussion of the Related Art

The rocker arm is designed so that as the cam is rotated in association with the crank shaft, the rocker arm is swung about its one end portion on the pivot side while causing the other end portion to push the valve stem vertically. Such rocker arm may be constructed in the following manner: That is, a threaded hole is formed in the one end portion of the rocker arm about which the latter is swung, and the pivot shaft is threadably engaged with the threaded hole thus formed.

A conventional rocker arm of this type is as shown in FIGS. 9 and 10.

In those figures, reference character C designates a cam; P, a pivot shaft; and V, a valve stem. The rocker arm comprises: a rocker arm body 21; and a roller 22 in contact with the cam C. The roller 22 is rotatably mounted on the rocker arm body 21 at the middle through a pin 23. The rocker arm body 21 has a pivot shaft mounting portion 24 at one end into which the pivot shaft P is inserted, and a valve engaging portion 25 at the other end which is adapted to push the valve stem V.

The rocker arm body 21 had been formed by casting; however, recently in order to reduce the manufacturing cost and the weight, it has been formed by pressing.

In the manufacture of the rocker arm body 21 by pressing, the pivot shaft mounting portion 24 and a pair of side walls 26 and 26 merging with the latter 24 are formed, as one unit, by blanking a plate material. The pivot shaft mounting portion 24 is shaped cylindrical.

More specifically, in order to form the rocker arm body 21, a base plate material 21A is prepared as shown in FIG. 11, which includes the side walls 26 and 26 extended longitudinally in a line. The base plate material 21A thus prepared is folded in two in such a manner that it is bent round along the folding line to provide the pivot shaft mounting portion which is cylindrical, and its predetermined portions are brought into contact with each other. Under this condition, those predetermined portions of the base material 21A are welded together so that the aimed pivot shaft mounting portion 24 is provided along the folding line, and the side walls 26 and 26 are held substantially in parallel with each other. A threaded hole **24*a* is formed in the pivot shaft mounting portion 24, so that the pivot shaft P is threadably engaged with the latter 24**.

The valve engaging portion 25 is provided in the form of a chip separate from the above-described base material 21A. The valve engaging portion 25 is set between the free end portions of the side walls 26 and 26, and welded to them.

The rocker arm thus formed involves various problems in mechanical strength and in manufacture because, as was described above, the pivot shaft mounting portion 24 is formed by cylindrically bending the base plate material.

The inner cylindrical surface of the pivot shaft mounting portion 24 thus formed is not perfect in circularity because it has the junction of the plate material. Hence, the threads cut in the inner cylindrical surface are not continuous, which makes it rather difficult to smoothly engage the pivot shaft P with the threaded holes **24*a* of the pivot shaft mounting portion 24. This difficulty may be eliminated by increasing the depth of the threads in the inner cylindrical surface of the pivot shaft mounting portion 24 until the threads become continuous. However, this will give rise to another problem that cutting the inner cylindrical surface of the pivot shaft mounting portion 24 deeper to form the threads decreases the wall thickness of the pivot shaft mounting portion 24**, and accordingly the mechanical strength of the latter.

In cutting the inner cylindrical surface of the pivot shaft mounting portion 24 to form the threads, the cutting force may break the junction of the plate material; i.e., it may open the pivot shaft mounting portion 24, which makes it difficulty to form the threads with high precision. In addition, during the operation of the rocker arm, the load applied thereto may open the pivot shaft mounting portion 24 breaking the junction of the plate material, thus loosening the pivot shaft P.

The pivot shaft mounting portion has a nut seat around the threaded hole **24*a*** which corresponds to the wall thickness of the plate material. This means that it is difficult to obtain a sufficient tightening torque; that is, it is difficult to tighten the pivot shaft sufficiently.

On the other hand, as was described above, the predetermined portions of the side walls 26 and 26, which are brought into contact with each other when the plate material 21 is folded in two, are welded together; that is, there must be a certain distance between the pivot shaft mounting portion 24 and the portion where the roller 22 is supported. Hence, it is impossible to reduce the dimension of the rocker arm. If the dimension is forcibly reduced, then the rocker arm will be decreased in mechanical strength.

SUMMARY OF THE INVENTION

Accordingly, an object of the invention is to eliminate the above-described difficulties accompanying a conventional rocker arm.

More specifically, an object of the invention is to provide a rocker arm having a rocker arm body formed by pressing in which the pivot shaft mounting portion is improved so that the rocker arm is light in weight and low in manufacturing cost and involves no problem in mechanical strength and in manufacture.

The foregoing object of the invention has been achieved by the provision of a rocker arm comprising: a rocker arm body which includes a pair of side walls, a pivot shaft mounting portion at one end, the pivot shaft mounting portion having a threaded hole with which a pivot shaft is threadably engaged, and a valve engaging portion at the other end; and a roller rotatably mounted on the rocker arm body at the middle, the roller being in contact with a cam, in which, according to the invention,

- at least the pair of side walls are prepared by blanking a place material,
- the pivot shaft mounting portion and the valve engaging portion are connected, as bridges, between the pair of side walls, and
- the periphery of the threaded hole formed in the pivot shaft mounting portion has a thickness larger than the wall thickness of the side walls.

In the rocker arm of the invention, the essential portions of the rocker arm body, namely, the side walls are prepared by blanking a plate material (made, for instance, of chrome-molybdenum steel (SCM) material regulated by JIS), and therefore the rocker arm is reduced in weight as much: The threaded hole for the pivot shaft is formed in the pivot shaft mounting port,on which is in the form of a flat bridge, and therefore the threads formed are accurately continuous. The depth of the threaded hole is larger than the wall thickness of the side walls. Hence, the pivot shaft can be positively engaged with the pivot shaft mounting portion.

The nature, utility and principle of the invention will be more clearly understood from the following detailed description and the appended claim when read in conjunction with the accompanying drawings.

BRIEF DESCRIPTION OF THE DRAWING(S)

DETAILED DESCRIPTION OF THE PREFERRED EMBODIMENTS

Preferred embodiments of this invention will be described with reference to FIGS. 1 through 8.

First Embodiment

An example of a rocker arm, which constitutes a first embodiment of the invention, will be described with reference to FIGS. 1 through 3.

Figure 1:
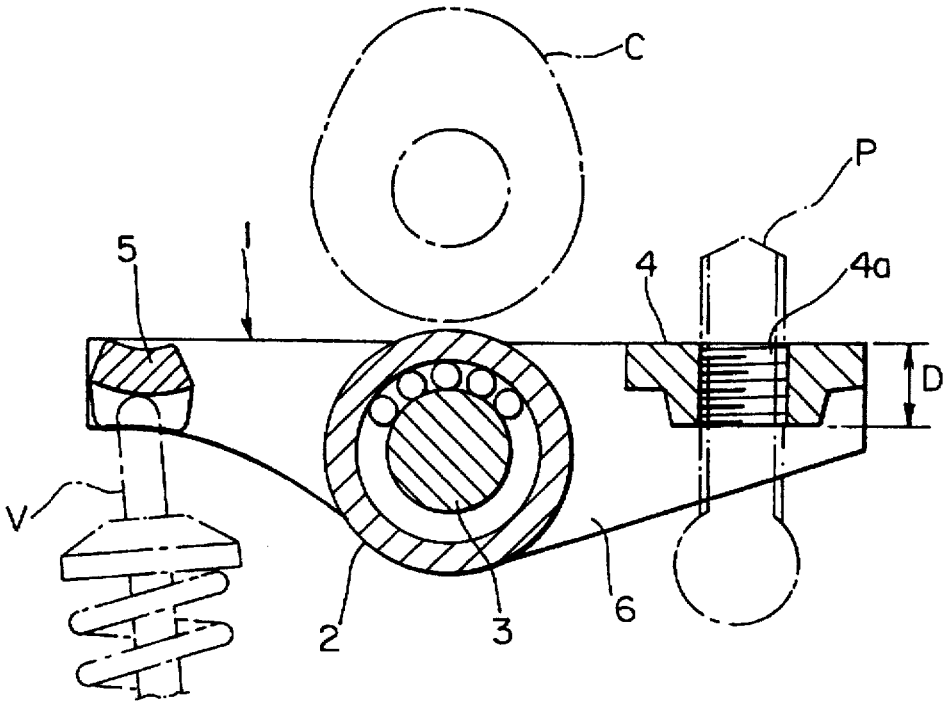
FIG. 1 is a longitudinal sectional view showing an example of a rocker arm, which constitutes a first embodiment of the invention.
Figure 2:
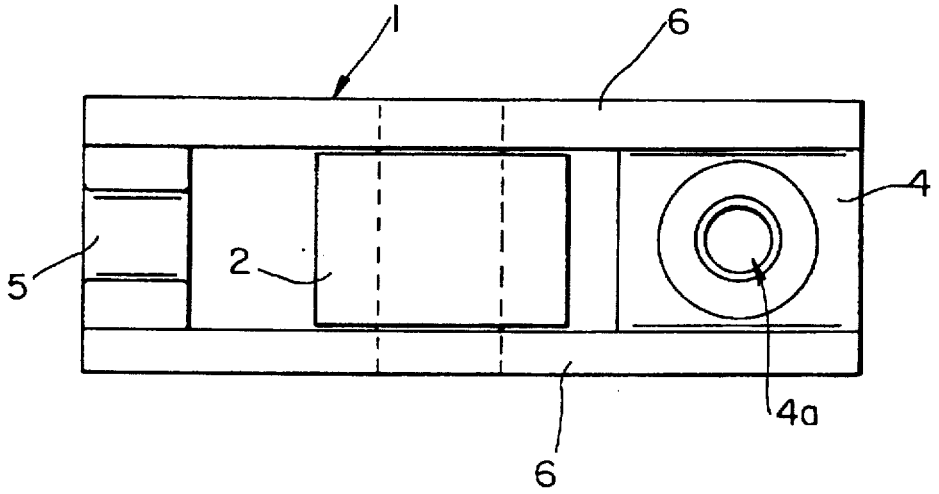
FIG. 2 is a bottom view of the rocker arm shown in FIG. 1.
Figure 3:
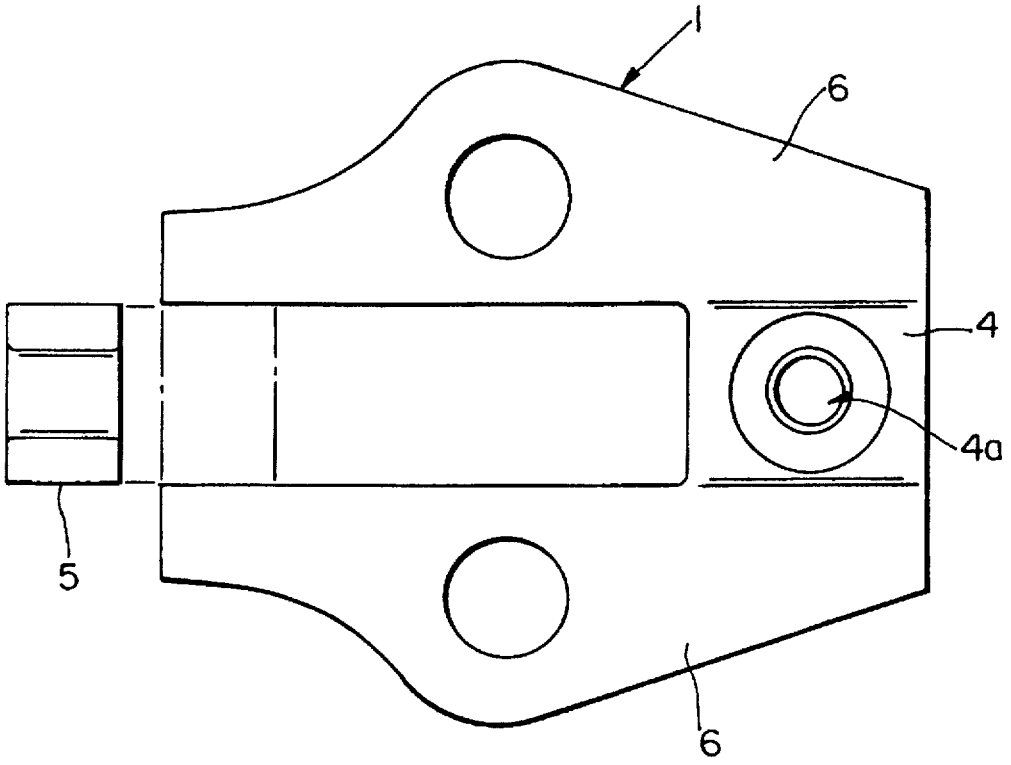
FIG. 3 is an unfolded view showing a rocker arm body in the first embodiment of the invention.

In FIGS. 1 through 3, reference character C designates a cam; P, a pivot shaft; and V, a valve stem. Similarly as in the case of the above-described conventional rocker arm, the rocker arm comprises a rocker arm body 1, and a roller 2 in contact with the cam C, the roller 2 being rotatably mounted on the rocker arm body 1 at the middle through a pin 3. Furthermore, the first embodiment is fundamentally similar to the conventional rocker arm in the following points: The rocker arm body 1 has a pivot shaft mounting portion 4 at one end with which the pivot shaft P is threadably engaged, and a valve engaging portion 5 at the other end which is adapted to push the valve stem V.

The rocker arm body 1 comprises a pair of side walls 6 and 6 and the aforementioned pivot shaft mounting portion 4 which are provided, as one unit, by blanking a plate material. That is, as shown in FIG. 3, the pivot shaft mounting portion. 4 is in the form of a bridge connected between the pair of side walls 6 and 6. The pivot shaft mounting portion 4 has a cylindrical protrusion at the center which is formed by burring. A threaded hole 4*a* is formed in the cylindrical protrusion for engagement with the pivot shaft P. The depth D of the threaded hole 4*a* is larger than the wall thickness of the plate material forming the side walls and the pivot shaft mounting portion.

The valve engaging portion 5 is a part of a valve engaging bridge between the side walls which is an inverted-U-shaped chip which is prepared separately from the plate material used to form the side walls 6 and the pivot shaft mounting portion 4. The valve engaging portion 5 is set at the other end of the rocker arm body 1, and connected to the end portions of the side walls 6 and 6.

As was described above, the side walls 6 and the pivot shaft mounting portion 4 are formed, as one unit, by blanking a plate material. Hence, the rocker arm body 1 can be fabricated relatively readily, and can be reduced in weight.

The threaded hole 4*a* for the pivot shaft P is formed in the pivot shaft mounting portion 4 which is in the form of a flat plate. Hence, the threaded hole 4*a* is high in circularity as in the case of the threaded hole of a nut; that is, the threads are accurately continuous. Thus, the pivot shaft P is accurately and smoothly engaged with the threaded hole 4*a*.

In addition, the depth D of the threaded hole 4*a* is larger than the wall thickness of the plate material forming the side walls and the pivot shaft mounting portion; that is, the thread engagement length of the threaded hole 4*a* with the pivot shaft P is sufficiently large, so that the pivot shaft P is positively secured to the pivot shaft mounting portion.

Second embodiment

Figure 4:
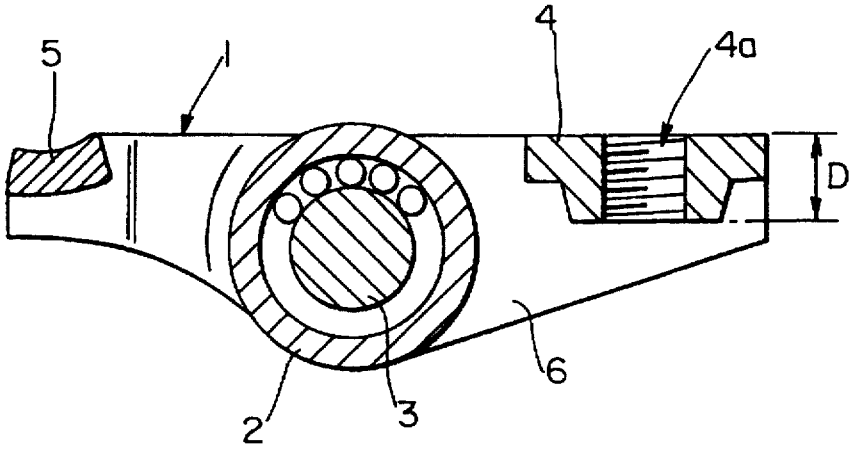
FIG. 4 is a longitudinal sectional view showing another example of the rocker arm, which constitutes a second embodiment of the invention.
Figure 5:
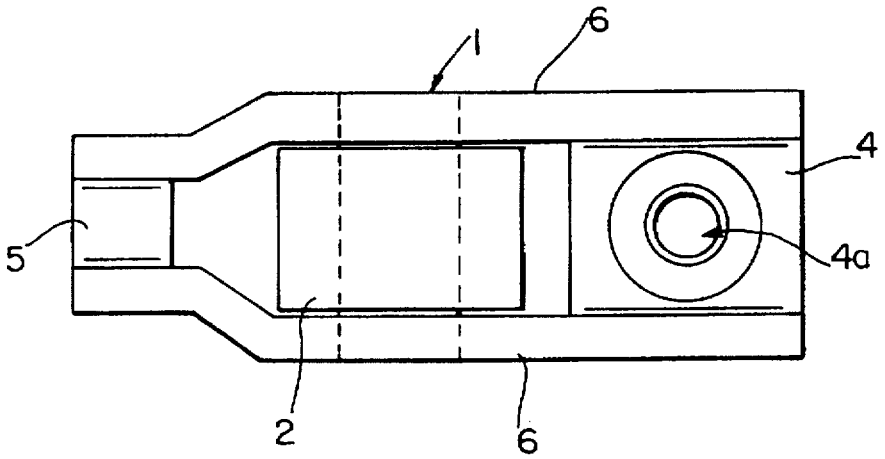
FIG. 5 is a bottom view of the rocker arm shown in FIG. 4.
Figure 6:
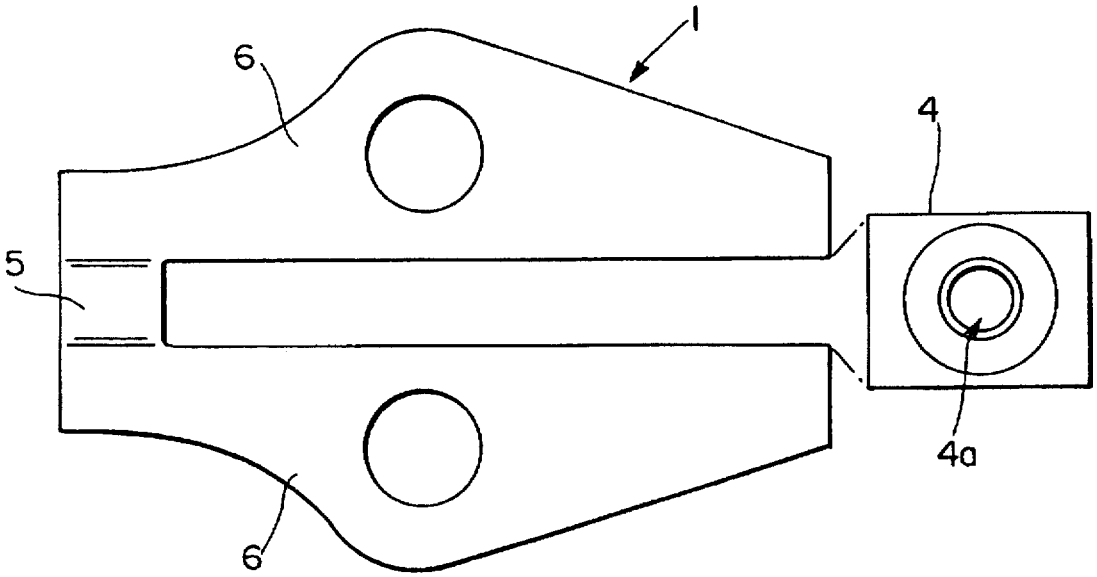
FIG. 6 is an unfolded view showing a rocker arm body in the second embodiment of the invention.

Another example of the rocker arm, which constitutes a second embodiment of the invention, is as shown in FIGS. 4 through 6.

In the second embodiment, similarly as in the first embodiment, its rocker arm body 1 comprises: a pivot shaft mounting portion 4: a pair of side walls 6 and 6; and a valve engaging portion 5. In the second embodiment, it should be noted that the side walls 6 and the valve engaging portion 5 are formed, as one unit, by blanking a plate material. The valve engaging portion 5 is in the form of a bridge connected between the side walls 6 and 6. The valve engaging portion 5 is smaller in width than the pivot shaft mounting portion 4. Hence, the side walls 6 and 6 are bent in such a manner that the distance between the portions of the side walls from the vicinity of the roller supporting pin 2 to the pivot shaft mounting portion 4 is larger than that between the remaining.

In the second embodiment, the pivot shaft mounting portion 4 is a chip having a threaded hole 4*a* at the center which is engaged with the pivot shaft P. The chip is prepared separately from the plate material forming the side walls 6 and the valve engaging portion 5. The pivot shaft mounting portion 4 is set at one end of the rocker arm body 1, and connected, as a bridge, between the end portions of the side walls 6 and 6. In the second embodiment too, the depth D of the threaded hole 4*a* of the pivot shaft mounting portion is larger than the wall thickness of the plate material forming the side walls 6 and the valve engaging portion 5.

In the second embodiment, similarly as in the case of the first embodiment, the rocker arm body 1 can be fabricated relatively readily, and can be reduced in weight. The threaded hole 4*a* for the pivot shaft P is high in circularity, and the threads are accurately continuous, so that the pivot shaft P is accurately and smoothly engaged with the threaded hole 4*a*. In addition, the thread engagement length of the threaded hole 4*a* with the pivot shaft P is sufficiently large, so that the pivot shaft P is positively secured to with the pivot shaft mounting portion.

In the second embodiment, the pivot shaft mounting portion 4 is a part provided separately from the rocker arm body 1 and is welded to the side walls 6. Hence, a simple nut may be employed as the pivot shaft mounting portion 4.

Figure 7:
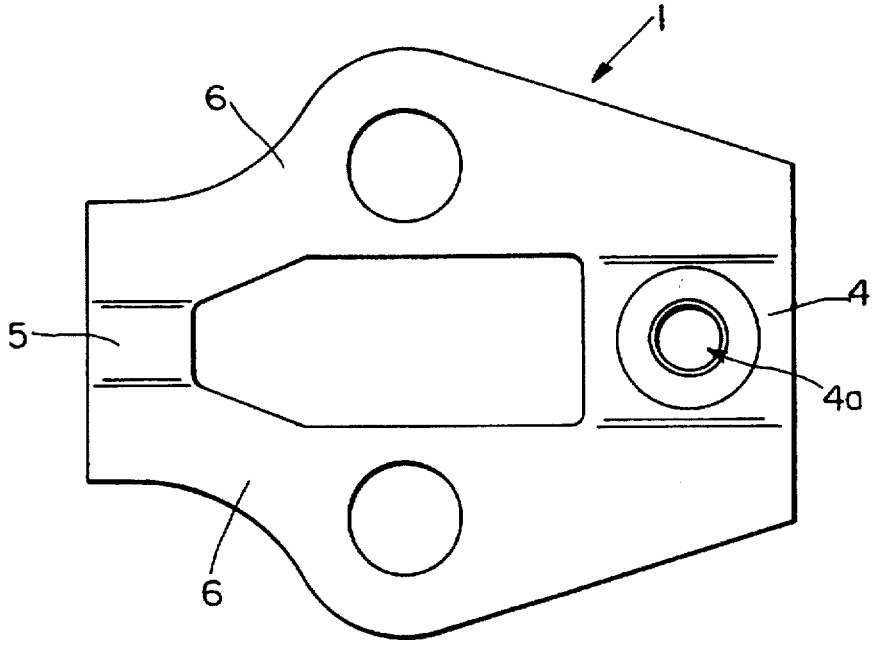
FIG. 7 is an unfolded view of a rocker arm body in another example of the rocker arm, which constitutes a third embodiment of the invention.
Figure 8:
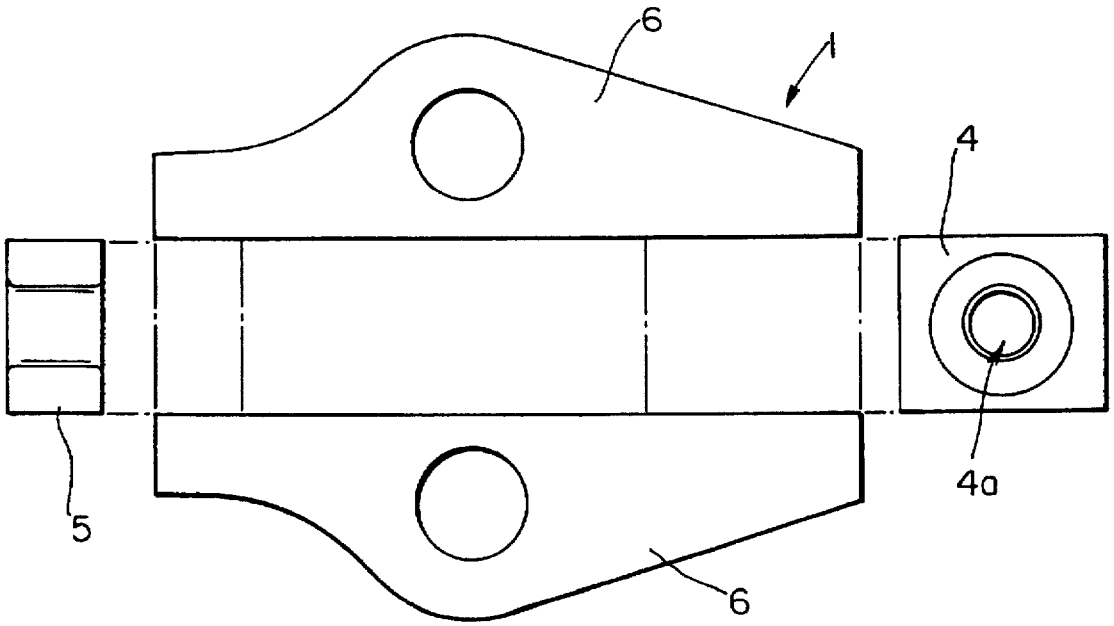
FIG. 8 is an unfolded view of a rocker arm body in another example of the rocker arm, which constitutes a fourth embodiment of the invention.
Figure 9:
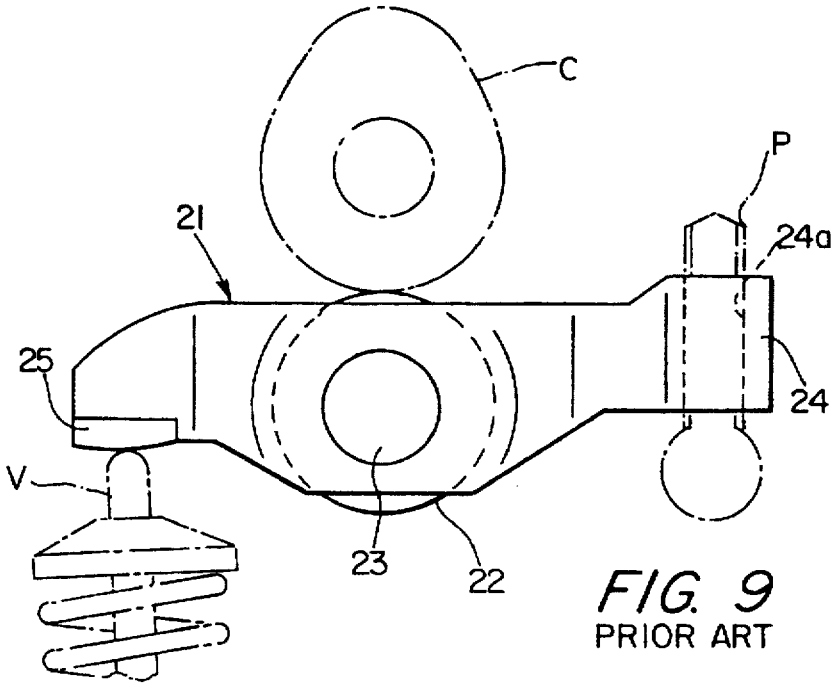
FIG. 9 PRIOR ART
FIGS. 9 and 10 are a side view and a plan view, respectively, showing a conventional rocker arm.
Figure 10:
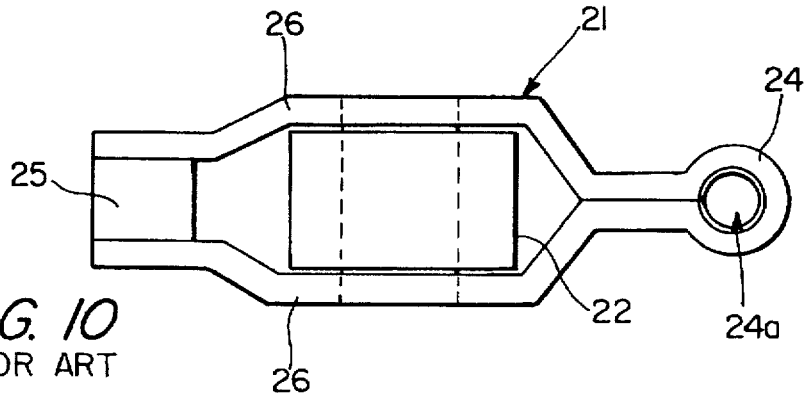
FIG. 10 PRIOR ART
Figure 11:
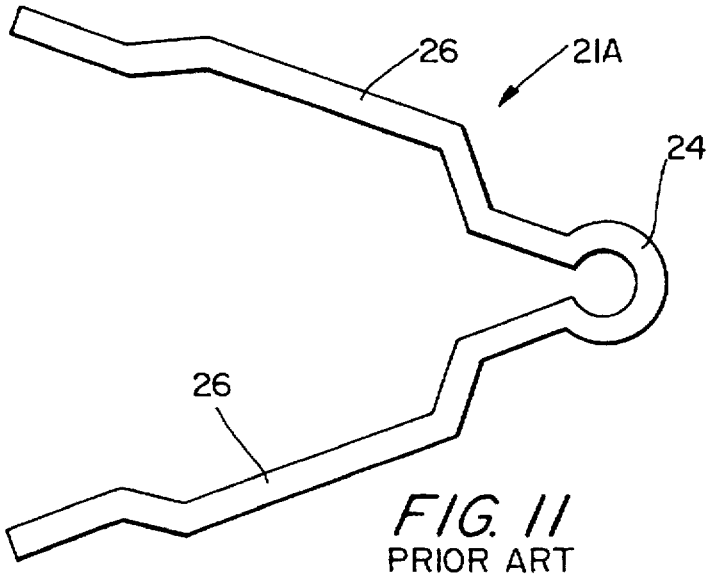
FIG. 11 PRIOR ART
FIG. 11 is a plan view showing a rocker arm body which is bent to form the conventional rocker arm.

In the above-described first embodiment, the pivot shaft mounting portion and the side walls are prepared as one unit by blanking a plate material; while in the second embodiment, the valve engaging portion and the side walls are prepared as one unit by blanking a plate material. However, the rocker arm may be formed as shown in FIG. 7 or 8, in which parts corresponding functionally to those which have been described with reference to the first or second embodiment are therefore designated by the same reference numerals or characters. That is, FIGS. 7 and 8 show other examples of the rocker arm, which constitute third and fourth embodiments of the invention, respectively.

Third embodiment

In the third embodiment, the rocker arm body 1; that is, the pair of side walls 6, the pivot shaft mounting portion 4, and the valve engaging portion 5 are prepared as one unit by blanking a plate material. The pivot shaft mounting portion 4, and the valve engaging portion 5 are in the form of bridges connected between the side walls 6. More specifically, the pivot shaft mounting portion is located at one end of the rocker arm body, and connected as a bridge between the side walls 6 and 6, while the valve engaging portion 5 is located at the other end of the rocker arm body and connected, as a bridge, between the side walls with. The pivot shaft mounting portion 4 has a cylindrical protrusion at the center which is formed by burring. A threaded hole 4*a* for the pivot shaft P is formed in the cylindrical protrusion thus formed.

Fourth Embodiment

In the fourth embodiment shown in FIG. 8, the pair of side walls 6 and 6, the pivot shaft mounting portion 4, and the valve engaging portion 5 are prepared separately from one another. The side walls are formed by blanking a plate material. The pivot shaft mounting portion is a chip having a threaded hole 4*a* at the center with which the pivot shaft P is engaged. The pivot shaft mounting portion 4 is connected between the side walls 6 and 6. More specifically, the pivot shaft mounting portion 4 is located at one end of the rocker arm body 1, and connected, as a bridge, between the side walls 6 and 6. The valve engaging portion 5 is an inverted-U-shaped chip, and it is also connected, as a bridge, between the side walls 6 at the other end of the rocker arm body 1.

Effects of the Invention

In the rocker arm of the invention, the essential components of the rocker arm body are prepared by blanking a plate material. Hence, in the rocker arm of the invention, similarly as in the case of the conventional rocker arm formed by pressing, its body is light in weight, and low in manufacturing cost.

Furthermore, since the threaded hole for the pivot shaft is formed in the pivot shaft mounting portion which is in the form of a flat bridge connected between the side walls, the threads are accurately continuous as those of the threaded hole of a nut, and therefore the pivot shaft can be accurately engaged with the pivot shaft mounting portion. In addition, the depth of the threaded hole is larger than the wall thickness of the side walls; that is, the thread engagement length of the threaded hole with the pivot shaft is sufficiently large, so that the pivot shaft is positively, secured to the pivot shaft mounting portion.

While there has been described in connection with the preferred embodiments of this invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A rocker arm comprising:

a pair of spaced outer side walls each having a first end, and a second end, upper portions and a wall thickness and a first bridge having a length extending between upper portions of said spaced side walls adjacent said first ends thereof and a substantially flat upper surface extending across and occupying and substantially defining the upper extent of said first bridge, said spaced side walls and said first bridge being formed of a single plate of material having an inverted U-shape section opening downwardly when the rocker arm is positioned in an operational position on a vehicle engine;

said first bridge comprising an integral pivot shaft mounting portion having a threaded hole formed in said plate extending downwardly from said substantially flat upper surface and said threaded hole being adapted to be threadingly engaged with a pivot shaft, said threaded hole being formed in a first portion of said plate that has a first plate thickness exceeding the wall thickness of said side walls;

a cam follower roller rotatably supported on a transversely extending shaft positioned between said side walls so that said cam follower roller is adapted to be in contact with a cam; and a second bridge serving as a valve engaging portion connected to and extending between said side walls at said second ends thereof.

2. A rocker arm according to claim 1, wherein said pivot shaft mounting portion includes a second portion having a second plate thickness which is less than said first plate thickness.

3. A rocker arm according to claim 2, wherein said first plate thickness is substantially equal to said wall thickness of said side walls.

4. A rocker arm comprising:

a pair of spaced side walls each having two ends and a wall thickness and a valve engaging bridge having a length extending between said spaced side walls at a first end thereof, said valve engaging bridge and said side walls being formed of a single plate of material having an inverted U-shape section opening downwardly when the rocker arm is positioned in an operational position on a vehicle engine;

a cam follower roller rotatably supported by a transversely extending shaft mounted on and extending between said side walls so that said roller is adapted to be in contact with a cam;

a pivot shaft engaging bridge connected to and extending between said side walls at a second end thereof opposite from said first end, said pivot shaft engaging bridge having a substantially flat upper surface extending across substantially the entire length and area of said pivot shaft engaging bridge; and wherein said pivot shaft engaging bridge has a thicker portion having a thickness greater than the wall thickness of said side walls with said thicker portion having a pivot shaft connector portion including a threaded hole extending downwardly from said substantially flat upper surface with said threaded hole being adapted to be threadingly engaged with a threaded pivot shaft.

5. A rocker arm according to claim 4, wherein said pivot shaft engaging bridge is welded to said side walls.

6. A rocker arm comprising:

a pair of side walls each having first and second ends and a width and first and second bridges each having a length and extending between said side walls at respective ends of said side walls, said side walls and said first and second bridges being formed of a single plate of material having a inverted U-shape section with the U-shape section opening downwardly when the rocker arm is positioned in an operational position on a vehicle engine and an upper portion of the U-shape section forming a substantially flat upper surface extending across the entire width of said first and second bridges;

a roller rotatably supported by a transversely extending shaft between said side walls so that said roller is adapted to be in contact with a cam; and whereas, said second bridge includes a valve engaging portion;

said first bridge includes an integral pivot shaft mounting portion formed with a threaded hole extending downwardly in said plate from said substantially flat upper surface of said first bridge and wherein said threaded hole is adapted to be threadingly engaged with a pivot shaft; and said threaded hole has a vertical length of engageable thread that is greater in length than the thickness of said side walls.

7. A rocker arm comprising:

a pair of side walls having first and second ends and a width and coplanar upper end surfaces and first and second bridges each having a length extending between said side walls at respective ends and an upper flat surface coplanar with the upper end surfaces of the side walls, said side walls and one of said bridges being formed of a single plate of material having an inverted U-shape section with the U-shape section opening downwardly when the rocker arm is positioned in an operational position on a vehicle engine;

a roller rotatably supported between said side walls so that said roller is adapted to be in contact with a cam, and wherein the other of said bridges includes a valve engaging portion, which has a lower convex surface and an upper concave surface.

* * * * *